US011199168B2

(12) United States Patent
Gerbeth et al.

(10) Patent No.: US 11,199,168 B2
(45) Date of Patent: Dec. 14, 2021

(54) DISTRIBUTOR APPARATUS OF A COMMON-RAIL SYSTEM

(71) Applicant: MTU Friedrichshafen GmbH, Friedrichshafen (DE)

(72) Inventors: Robby Gerbeth, Tettnang (DE); Oscar Blasco, Friedrichshafen (DE); Hubert Lugger, Friedrichshafen (DE); Frank Mlicki, Messkirch (DE); Thilo Kreeb, Ravensburg (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 17/009,164

(22) Filed: Sep. 1, 2020

(65) Prior Publication Data

US 2020/0392927 A1 Dec. 17, 2020

Related U.S. Application Data

(63) Continuation of application No. PCT/EP2019/055348, filed on Mar. 4, 2019.

(30) Foreign Application Priority Data

Mar. 2, 2018 (DE) ..... 10 2018 104 848.3

(51) Int. Cl.
*F02M 55/02* (2006.01)
*F02M 55/04* (2006.01)
*F02M 55/00* (2006.01)

(52) U.S. Cl.
CPC ..... *F02M 55/025* (2013.01); *F02M 55/004* (2013.01); *F02M 55/04* (2013.01);
(Continued)

(58) Field of Classification Search
CPC .... F02M 55/025; F02M 55/004; F02M 55/04; F02M 2200/247; F02M 2200/28; F02M 2200/315
(Continued)

(56) References Cited

U.S. PATENT DOCUMENTS 7,422,001 B2 * 9/2008 Kaneko ..... F02M 55/02 123/456
8,100,111 B2 * 1/2012 Stingele ..... F02M 55/04 123/456
(Continued)

FOREIGN PATENT DOCUMENTS

DE 10 2006 034 515 B3 5/2007
DE 10 2006 003 639 A1 8/2007
(Continued)

OTHER PUBLICATIONS

International Search Report and Written Opinion dated May 28, 2019 for International Application No. PCT/EP2019/055348 (12 pages).

*Primary Examiner* — Mahmoud Gimie
(74) *Attorney, Agent, or Firm* — Taylor IP, P C.

(57) ABSTRACT

A distributor apparatus of a common rail system for an internal combustion engine. The distributor apparatus is designed with at least one distributor device having a high-pressure line for fuel and a plurality of feed lines branching off from the high-pressure line within the distributor device. Each feed line leads to an individual accumulator and an injector. The feed line is associated with a restriction device and a discharge bore, which is designed to cooperate with a pressure-measuring device and which is arranged downstream of the restriction device, such that the restriction device is arranged in the feed line and the
(Continued)

discharge bore, arranged in the distributor device, is connected to the feed line downstream of the restriction device.

14 Claims, 3 Drawing Sheets

(52) U.S. Cl.
CPC ... *F02M 2200/247* (2013.01); *F02M 2200/28* (2013.01); *F02M 2200/315* (2013.01)

(58) Field of Classification Search
USPC ..... 123/456
See application file for complete search history.

(56) References Cited

U.S. PATENT DOCUMENTS

| | | | | |
|---|---|---|---|---|
| 2009/0223486 | A1 * | 9/2009 | Weizenauer | F02M 63/0295 123/447 |
| 2009/0241907 | A1 | 10/2009 | Kondo et al. | |
| 2018/0010565 | A1 | 1/2018 | Furukawa | |

FOREIGN PATENT DOCUMENTS

| | | | | |
|---|---|---|---|---|
| DE | 10 2009 055 129 | A1 | 6/2011 | |
| DE | 10 2014 007 963 | A1 | 12/2015 | |
| EP | 1316720 | A1 * | 6/2003 | F02D 41/3836 |
| JP | 2007100656 | A * | 4/2007 | |

* cited by examiner

DISTRIBUTOR APPARATUS OF A COMMON-RAIL SYSTEM

CROSS REFERENCE TO RELATED APPLICATIONS

This is a continuation of PCT application No. PCT/EP2019/055348, entitled "DISTRIBUTOR APPARATUS OF A COMMON-RAIL SYSTEM", filed Mar. 4, 2019, which is incorporated herein by reference.

BACKGROUND OF THE INVENTION

1. Field of the Invention

The present invention relates to a distributor apparatus of a common rail system for an internal combustion engine.

2. Description of the Related Art

Common rail systems with different distributor apparatuses—also known as rails, rail segments or distributor blocks—are generally known in the art. Via the distributor apparatus, pressurized fuel is generally fed through a high pressure line which progresses in an axial direction of the distributor apparatus to injectors for injection into a combustion chamber. In so-called common rail systems with induvial accumulators several feed lines branch off from the high pressure line. Each the feed line interacts with an injector and may include a choke valve and an individual accumulator, which are arranged inside a cylinder head cover. To achieve the desired supply of fuel to the injectors, the distributor apparatus and the individual accumulators are hydraulically coordinated with each other in such a way that the respective individual accumulator is again filled with fuel following an injection process.

A pressure sensor is allocated to each injector in order to capture a pressure in the region of the individual accumulators. The provision of a pressure sensor, however, requires a complex design of an injector housing with high pressure regions that must be sealed accordingly.

The injector housing becomes increasingly complex if high pressure sealing locations, for example for a pressure sensor, have to be monitored and if detection bores have to be provided for this purpose. Sealing points can be positioned closely together, for example with a so-called top-feed connection concept in order to keep the expenditure for detection bores as low as possible. However, the design of the cylinder head cover becomes very complex.

A pressure measuring device for a common rail system with individual accumulators is known from DE 10 2006 034 515 B3, wherein the pressure measuring device is located in the sealing plug of the individual accumulator. However, leakage detection is difficult in this case.

Additional distributor apparatuses with several distributor devices for supplying individual injectors with individual storage volumes are known from DE 10 2009 055 129 A1, DE 10 2006 003 639 A1, and DE 10 2014 007 963 A1.

What is needed in the art is an improved distributor apparatus of a common rail system for an internal combustion engine.

SUMMARY OF THE INVENTION

The present invention provides a distributor apparatus of a common rail system for an internal combustion engine which allows for a simple design of an injector or respectively a cylinder head cover, as well as simple leakage detection.

The present invention in one form is directed to a distributor apparatus of a common rail system of an internal combustion engine. The distributor apparatus is equipped with at least one distributor device having a high pressure line for fuel and with several feed lines branching off from the high pressure line inside the distributor apparatus, wherein the feed lines each lead to an individual accumulator and an injector. According to the invention a throttle device and a discharge bore which is designed to interact with a pressure measuring device are allocated to the feed line downstream from the throttle device in such a way that the throttle device is arranged in the feed line and the discharge bore arranged in the distributor apparatus is connected with the feed line downstream of the throttle device.

The present invention in another form is directed to a distributor apparatus of a common rail system of an internal combustion engine. The common rail system includes a plurality of accumulators and a plurality of injectors fluidly connected to the plurality of accumulators. The distributor apparatus includes at least one distributor device configured for distributing a fuel. The at least one distributor device includes a high pressure line for conveying the fuel and a plurality of feed lines branching off from the high pressure line inside of the at least one distributor device. Each feed line of the plurality of feed lines being configured for leading to a respective accumulator of the plurality of accumulators. The distributor apparatus further includes a plurality of throttle devices. Each throttle device of the plurality of throttle devices is arranged in a respective feed line of the plurality of feed lines. The distributor apparatus further includes a plurality of pressure measuring devices connected to the at least one distributor device and a plurality of discharge bores. Each discharge bore of the plurality of discharge bores is arranged in the at least one distributor device. Each discharge bore of the plurality of discharge bores interacting with a respective pressure measuring device of the plurality of pressure measuring devices. Each discharge bore of the plurality of discharge bores is allocated to and connected with a respective feed line of the plurality of feed lines downstream of the plurality of throttle devices.

The present invention in yet another form is directed to a common rail system of an internal combustion engine. The common rail system includes a plurality of accumulators, a plurality of injectors fluidly connected to the plurality of accumulators, and a distributor apparatus. The distributor apparatus including at least one distributor device configured for distributing a fuel. The at least one distributor device including a high pressure line for conveying the fuel and a plurality of feed lines branching off from the high pressure line inside of the at least one distributor device. Each feed line of the plurality of feed lines is connected to a respective accumulator of the plurality of accumulators. The distributor apparatus further includes a plurality of throttle devices. Each throttle device of the plurality of throttle devices is arranged in a respective feed line of the plurality of feed lines. The disturber apparatus further includes a plurality of pressure measuring devices connected to the at least one distributor device and a plurality of discharge bores. Each discharge bore of the plurality of discharge bores being arranged in the at least one distributor device. Each discharge bore of the plurality of discharge bores interacting with a respective pressure measuring device of the plurality of pressure measuring devices. Each discharge bore of the plurality of discharge bores is allocated to and connected with a respective feed line of the plurality of feed lines downstream of the plurality of throttle devices.

A distributor apparatus designed according to the invention, or respectively an energy storing device enables simple construction of the injectors and the cylinder head cover since the throttle device that is arranged in known designs in the region of the injector and the pressure measuring device are moved from the injector and the cylinder head cover to the distributor apparatus. Thus, a larger and more easily configurable space is available in the region of the cylinder head cover. Due to the elimination of cables of the pressure measuring device being routed through the cylinder head cover, sealing in the region of the cylinder head cover is simplified.

The invention moreover offers the advantage that a connection of the high pressure line to the injector is freely selectable and can be designed for example as an external top-feed connection or as an internal connection by way of a pressure tube connection. Due to the fact that the pressure measuring device and the choke valve are arranged in the region of the distributor device, the pressure functionality of the individual accumulator can be of modular design and the injector body can be standardized.

Due to the solution according to the invention, short feed lines to the injector are moreover possible, resulting in a reduction of vibrations, reduced stresses on seals and reduced idle time, whereby the reduced idle time leads to a precise recognition of an injection start and an injection end.

It should be appreciated that the characteristics cited in the patent claims, as well as the characteristics of the following exemplary embodiment of the distributor apparatus according to the invention are each suitable on their own or in any desired combination.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
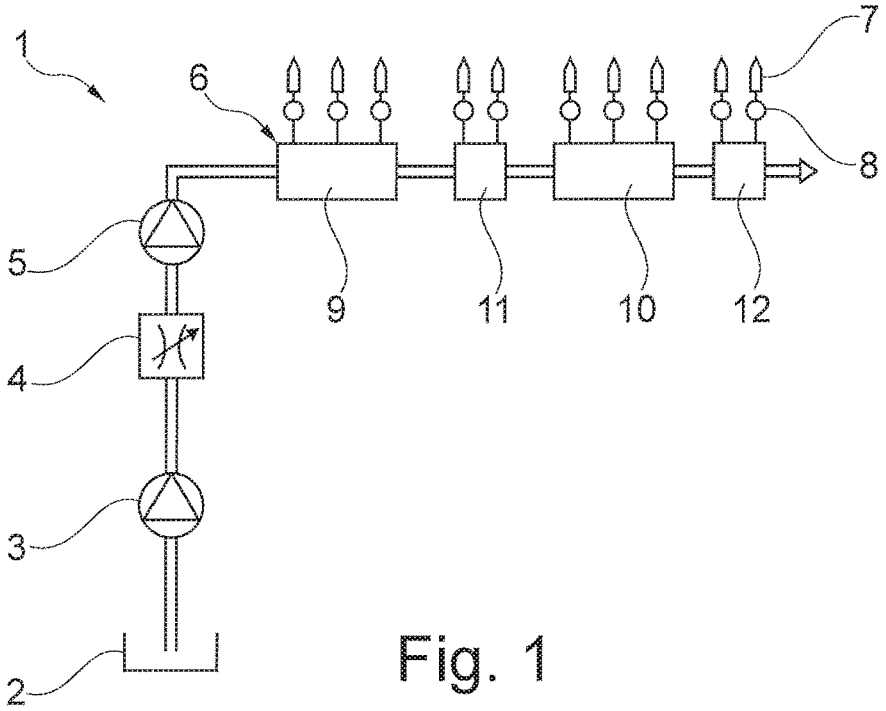
FIG. 1 illustrates a schematic diagram of a common rail system with a distributor apparatus which includes several distributor devices in the embodiment of rails and distributor blocks.
Figure 2:
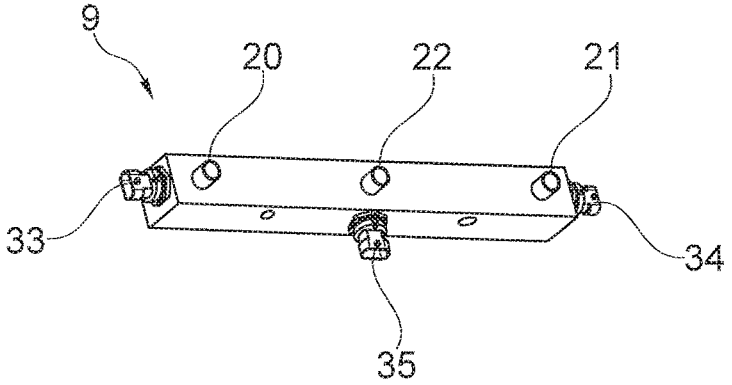
FIG. 2 is a perspective view of a distributor device of the distributor apparatus as shown in FIG. 1, wherein the distributor device is in the embodiment of a rail.
Figure 3:
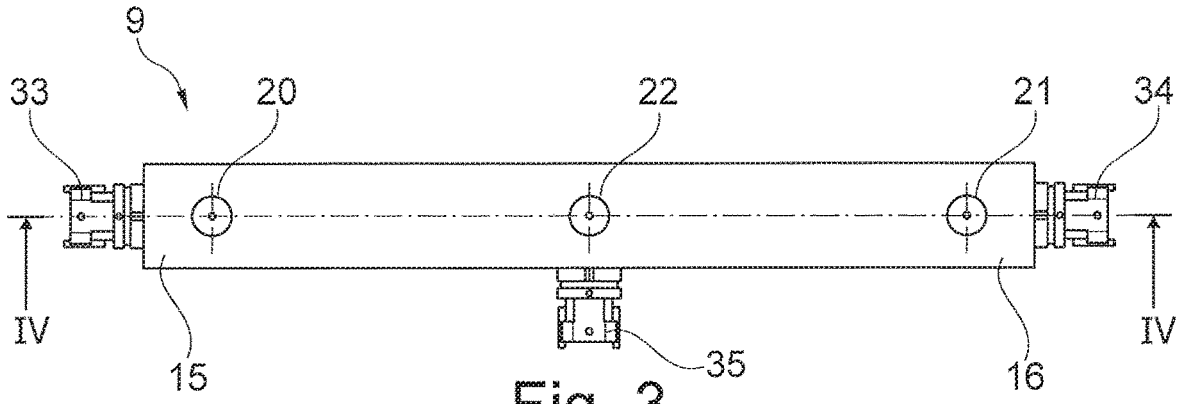
FIG. 3 is a top view of the rail according to FIG. 2.
Figure 4:
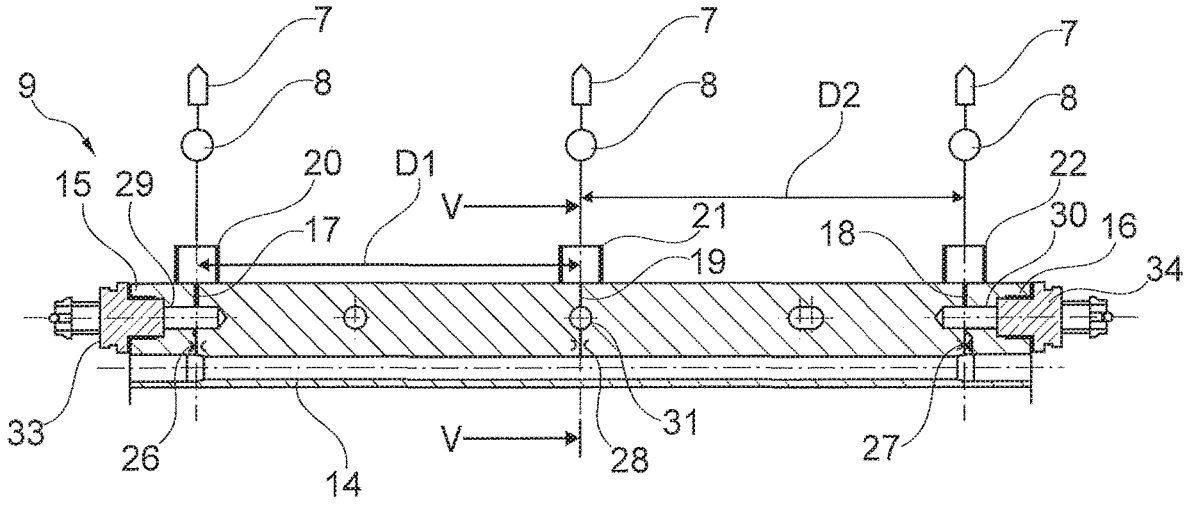
FIG. 4 is a sectional view of the rail, taken along line IV-IV of FIG. 3.
Figure 5:
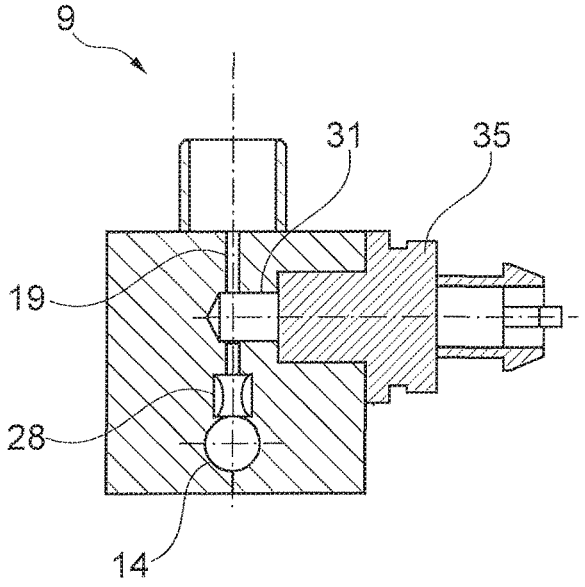
FIG. 5 is a sectional view of the rail, taken along line V-V of FIG. 4.

FIG. 1 illustrates a common rail system 1 of an internal combustion engine which includes a low pressure pump 3 for conveying fuel out of a fuel tank 2, an adjustable suction throttle 4 to control the fuel volume flow, a high pressure pump 5 to convey the fuel under increased pressure and a distributor apparatus 6. Distributor apparatus 6 is designed for storing fuel and for distributing the fuel to several injectors 7 which are illustrated in a simplified depiction and which are connected in each case with an individual accumulator 8 or which are designed integral with the same, and by way of which fuel can be injected into a combustion chamber of an internal combustion engine.

Distributor apparatus 6 herein is designed in segments with two essentially structurally identical distributor devices 9, 10 in the embodiment of rails; and two essentially structurally identical distributor devices 11, 12 in the embodiment of distributor blocks, whereby—in delivery direction of the fuel, originating from high pressure pump 5—first a rail 9, followed by a distributor block 11 and then a further rail 10 with a subsequent distributor block 12 are provided. Additional segments with distributor devices can connect to the arrangement.

Figure 8:
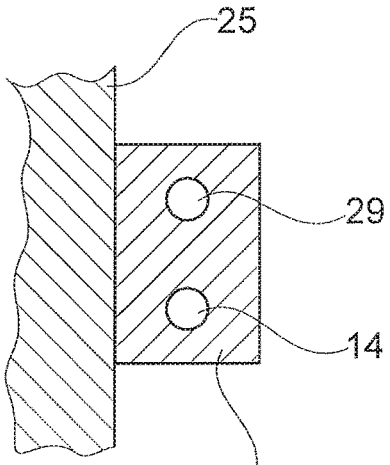
FIG. 8 is section view of the common rail system according to FIG. 1, wherein the arrangement of the distributor apparatus is shown on a crankcase.

FIG. 2 to FIG. 5 show a distributor device 9 in the embodiment of a rail in more detail which, according to FIG. 8 is designed as a so-called slim rail and which can be arranged on a crank housing 25. Rail 9 includes a high pressure line 14 in the embodiment of a longitudinal bore. The high pressure line 14 extends substantially in a longitudinal direction or axis or respectively in axial direction of distributor device 9, which pressure line is connected in a first axial end region 15 of rail 9 with high pressure pump 5 and in a second axial end region 16 with the subsequent distributor block 11.

Inside rail 9, three feed lines 17, 18, 19 branch off from high pressure line 14—in this case in the form of parallel transverse bores which extend substantially perpendicular relative to high pressure line 14 and which in a peripheral region of rail 9 are each designed having a flange-like connecting region 20, 21, 22 through which respective feed line 17, 18, 19 is hydraulically connected with an individual accumulator 8 and an injector 7 fluidly connected to the accumulator 8. A distance D1, D2 which is located in longitudinal direction between adjacent connecting regions 20 and 21, or 21 and 22 corresponds in particular to a distance between two adjacent cylinders in the internal combustion engine.

In the illustrated arrangement, each feed line 17, 18, 19 has allocated to it a throttle device 26, 27, 28 and a discharge bore 29, 30, 31 for pressure measurement, wherein throttle device 26, 27 or 28 is arranged in respective feed line 17, 18, 19 in each case upstream of respective discharge bore 29, 30 or 31. Throttle devices 26, 27, 28 herein constitute a choke valve for allocated injector 7. Discharge bores 29, 30, 31 are arranged in this case in an axial longitudinal sectional plane parallel to the plane in which high pressure line 14 extends. Discharge bores 29, 30 are connected with feed lines 17, 18 at respective ends 15, 16 of rail 9 and extend in longitudinal direction of rail 9, and discharge bore 31 of center feed line 19 extends perpendicular thereto.

Three pressure measuring devices 33, 34, 35 are provided, which are respectively connected with rail 9 in the region of discharge bores 29, 30, 31 and are for example screwed onto the same. By way of pressure measuring devices 33, 34, 35 which can be designed as conventional high pressure sensors with appropriate on-site electronics and which can be connected with an electronic controller of the internal combustion engine, a pressure in feed line(s) 17, 18, 19 which corresponds with a pressure in respective individual accumulator 8 of injector 7 can be measured.

Figure 6:
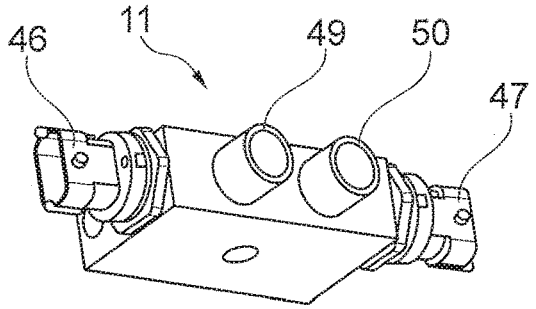
FIG. 6 is a perspective view of an additional distributor device of the distributor apparatus shown in FIG. 1, wherein the distributor device is in the embodiment of a distributor block.
Figure 7:
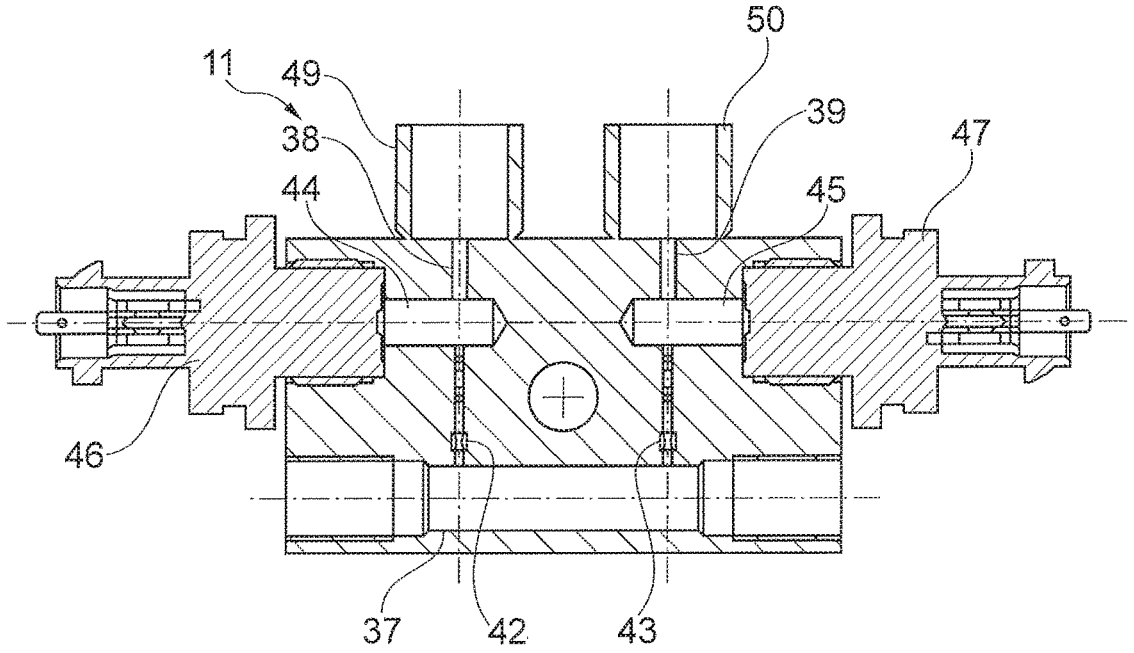
FIG. 7 is a longitudinal sectional view of the distributor block according to FIG. 6.

FIG. 6 and FIG. 7 illustrate more clearly an additional distributor device 11 in the embodiment of a distributor block. Similar to rail 9, distributor block 11 is designed with a high pressure line 37 in axial longitudinal direction which is connected with high pressure line 14 of rail 9. In contrast to rail 9, distributor block 11 only has two feed lines 38, 39 branching off from a high pressure line 37, which are arranged comparable to feed lines 17 and 18 of rail 9. Feed lines 38, 39 each are again designed with a connecting region 49, 50 via which each feed line 38, 39 is connected with individual accumulator 8 and injector 7.

Each feed line 38, 39 has again allocated to it a throttle device 42, 43 and a discharge bore 44, 45 which interacts with a pressure measuring device 46, 47. Distributor block 11 is thus designed substantially comparable to rail 9 with a shorter longitudinal extension.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LISTING

1 Common rail system
2 Fuel tank
3 Low pressure pump
4 Suction throttle
5 High pressure pump
6 Distributor apparatus
7 Injector
8 Individual accumulator
9 Distributor device, rail
10 Distributor device, rail
11 Distributor device, distributor block
12 Distributor device, distributor block
14 High pressure line
15 First axial end region
16 Second axial end region
17 First feed line
18 Second feed line
19 Third feed line
20 Connecting region
21 Connecting region
22 Connecting region
25 Crank housing
26 Throttle device
27 Throttle device
28 Throttle device
29 Discharge bore
30 Discharge bore
31 Discharge bore
33 Pressure measuring device
34 Pressure measuring device
35 Pressure measuring device
37 High pressure line
38 Feed line
39 Feed line
42 Throttle device
43 Throttle device
44 Discharge bore
45 Discharge bore
46 Pressure measuring device
47 Pressure measuring device
49 Connecting region
50 Connecting region
D1 Distance
D2 Distance

What is claimed is:

1. A distributor apparatus of a common rail system of an internal combustion engine, the common rail system comprising a plurality of accumulators and a plurality of injectors fluidly connected to the plurality of accumulators, the distributor apparatus comprising:

at least one distributor device configured for distributing a fuel, the at least one distributor device comprising:

a high pressure line for conveying the fuel; and a plurality of feed lines branching off from the high pressure line inside of the at least one distributor device, each feed line of the plurality of feed lines being configured for leading to a respective accumulator of the plurality of accumulators;

a plurality of throttle devices, each throttle device of the plurality of throttle devices being arranged in a respective feed line of the plurality of feed lines;

a plurality of pressure measuring devices connected to the at least one distributor device; and a plurality of discharge bores, each discharge bore of the plurality of discharge bores being arranged in the at least one distributor device, each discharge bore of the plurality of discharge bores interacting with a respective pressure measuring device of the plurality of pressure measuring devices, each discharge bore of the plurality of discharge bores being allocated to and connected with a respective feed line of the plurality of feed lines downstream in series of the plurality of throttle devices.

2. The distributor apparatus according to claim 1, wherein each feed line of the plurality of feed lines has allocated to it a respective throttle device of the plurality of throttle devices and a respective discharge bore of the plurality of discharge bores for interaction with a respective pressure measurement device of the plurality of pressure measurement devices.

3. The distributor apparatus according to claim 1, wherein the at least one distributor device defines a longitudinal axis, wherein the high pressure line extends axially along the longitudinal axis.

4. The distributor apparatus according to claim 1, wherein each discharge bore of the plurality of discharge bores is arranged axially parallel or perpendicular relative to the high pressure line in a plane parallel to the high pressure line.

5. The distributor apparatus according to claim 1, wherein the at least one distributor device is in the form of several distributor devices.

6. The distributor apparatus according to claim 5, wherein the high pressure lines of the several distributor devices are hydraulically coupled with one another.

7. The distributor apparatus according to claim 5, wherein each distributor device of the several distributor devices is in the form of one of a rail and a distributor block.

8. A common rail system of an internal combustion engine, comprising:

a plurality of accumulators;

a plurality of injectors fluidly connected to the plurality of accumulators; and a distributor apparatus, comprising:

at least one distributor device configured for distributing a fuel, the at least one distributor device comprising:

a high pressure line for conveying the fuel; and a plurality of feed lines branching off from the high pressure line inside of the at least one distributor device, each feed line of the plurality of feed lines being fluidly connected to a respective accumulator of the plurality of accumulators;

a plurality of throttle devices, each throttle device of the plurality of throttle devices being arranged in a respective feed line of the plurality of feed lines;

a plurality of pressure measuring devices connected to the at least one distributor device; and a plurality of discharge bores, each discharge bore of the plurality of discharge bores being arranged in the at least one distributor device, each discharge bore of the plurality of discharge bores interacting with a respective pressure measuring device of the plurality of pressure measuring devices, each discharge bore of the plurality of discharge bores being allocated to and connected with a respective feed line of the plurality of feed lines downstream in series of the plurality of throttle devices.

9. The common rail system according to claim 8, wherein each feed line of the plurality of feed lines has allocated to it a respective throttle device of the plurality of throttle devices and a respective discharge bore of the plurality of discharge bores for interaction with a respective pressure measurement device of the plurality of pressure measurement devices.

10. The common rail system according to claim 8, wherein the at least one distributor device defines a longitudinal axis, wherein the high pressure line extends axially along the longitudinal axis.

11. The common rail system according to claim 8, wherein each discharge bore of the plurality of discharge bores is arranged axially parallel or perpendicular relative to the high pressure line in a plane parallel to the high pressure line.

12. The common rail system according to claim 8, wherein the at least one distributor device is in the form of several distributor devices.

13. The common rail system according to claim 12, wherein the high pressure lines of the several distributor devices are hydraulically coupled with one another.

14. The common rail system according to claim 12, wherein each distributor device of the several distributor devices is in the form of one of a rail and a distributor block.

* * * * *